United States Patent [19]

Eyssa et al.

[11] Patent Number: 4,622,531

[45] Date of Patent: Nov. 11, 1986

[54] SUPERCONDUCTING ENERGY STORAGE MAGNET

[75] Inventors: Yehia M. Eyssa; Roger W. Boom, both of Madison; Warren C. Young, Middleton, all of Wis.; Glen E. McIntosh, Boulder, Colo.; Mostafa K. Abdelsalam, Madison, Wis.

[73] Assignee: Wisconsin Alumni Research Foundation, Madison, Wis.

[21] Appl. No.: 727,489

[22] Filed: Apr. 26, 1985

[51] Int. Cl.[4] ..... H01F 7/22

[52] U.S. Cl. ..... 335/216; 335/299

[58] Field of Search ..... 335/216, 299; 174/126 S, 128 S, 15 CA

[56] References Cited

U.S. PATENT DOCUMENTS

| | | | |
|---|---|---|---|
| 3,444,495 | 5/1969 | Thomas | 336/223 |
| 3,514,730 | 5/1970 | Kassner | 335/216 |
| 3,919,677 | 11/1975 | Young et al. | 335/216 |
| 3,980,981 | 9/1976 | Boom et al. | 335/216 |
| 4,032,959 | 6/1977 | Boom et al. | 323/44 F |
| 4,079,305 | 3/1978 | Peterson et al. | 363/27 |
| 4,122,512 | 10/1978 | Peterson et al. | 363/14 |
| 4,379,275 | 4/1983 | Elsel | 335/216 |
| 4,418,325 | 11/1983 | Elsel | 335/216 |
| 4,467,303 | 8/1984 | Laskaris | 335/216 |
| 4,482,878 | 11/1984 | Burgeson et al. | 335/216 |
| 4,549,156 | 10/1985 | Mine et al. | 335/216 |
| 4,568,900 | 2/1986 | Agatsuma et al. | 335/216 |

*Primary Examiner*—George Harris

*Attorney, Agent, or Firm*—Isaksen, Lathrop, Esch, Hart & Clark

[57] ABSTRACT

A superconducting energy storage magnet is formed having inner (13) and outer (14) coils which are supported and restrained by an inner support structure (15) comprised of thermal and electrically conductive rails (33) which engage and parallel the turns of composite conductors (30, 31) in the two coils. Each of the support rails (33) is electrically isolated from adjacent support rails by insulating spacers (33) between layers and an insulating spacer (35) between the rails for the inner and outer coils. The spacing between turns in the inner and outer coils preferably progressively decreases toward the top and bottom ends of the magnet in a manner to best direct the magnetically induced forces on the composite conductors (30, 31) into the inner support structure. The two layer coil structure causes the forces on the conductors when current is flowing therethrough to be directed primarily inwardly toward the inner support structure (15).

23 Claims, 9 Drawing Figures

SUPERCONDUCTING ENERGY STORAGE MAGNET

FIELD OF THE INVENTION

This invention pertains generally to the field of electrical energy storage magnets and particularly to superconducting storage magnets with support structure.

BACKGROUND OF THE INVENTION

Energy storage using large superconducting magnets has been proposed for leveling daily load requirements on electrical utility systems. Excess energy generated during off-peak hours can be stored and later returned to the power grid during high demand periods. By connecting the superconducting energy storage magnet to the power system with a bridge-type inverter, it is possible to obtain very efficient energy transfer between the storage magnet and the power system, as more fully described in U.S. Pat. No. 4,122,512 to Peterson, et al.

The large energy storage magnets proposed for storing sufficient energy to allow load leveling on a power grid utilize multiple turns of composite normal and superconducting material. The current flowing in the turns of the magnet naturally produces a net magnetic field and any conductor in the field will experience a force at each point on the conductor oriented at right angles to the current and the magnetic field. Since superconducting magnets of the size proposed for electrical system energy storage will conduct extremely large currents and will generate strong magnetic fields, the forces experienced by the conductors will be very large. If the turns of the magnet coil were formed as conventional circular turns, and were unsupported, the tension at any cross-section in the conductor would be equal to BIR, where B is the component of the magnetic field experienced by the conductor perpendicular to the plane of the conductor (axial magnetic field), I is the current in the conductor, and R is the radius of curvature of the turn. In the large energy storage magnets under consideration, all of these factors will be very large, e.g., several hundred thousand amperes will be conducted in a field of several teslas in a solenoid magnet having a radius which may be several hundred meters. Since no conductor by itself could possibly withstand the forces that would be exerted on the conductor under these conditions, an external support structure capable of resisting the large loads imposed on the conductor is thus necessary. However, substantial practical difficulties are encountered in supporting the superconducting magnet because of the supercooled conditions under which the magnets must be operated. The support structure must not add a significant thermal load on the cooling system and must be capable of adjusting to the expansions and contractions encountered during the initial cooldown of the system and any subsequent heating and cooling cycles.

One approach to the problem of adequately supporting a superconducting magnet is shown in the U.S. Pat. No. 3,980,981 to Boom, et al. The structure disclosed in that patent includes a rippled composite superconducting-normal conductor which is laid out in a single layer of turns disposed in a trench formed in the ground. Each ripple in the conductor lies in a plane normal to the net magnetic field experienced by that conductor. The outward force on the conductor is opposed by support columns which engage the conductor at its innermost portions between the ripples. The supporting columns extend radially to an outer support wall which may be formed in bedrock. The columns can be made of insulating material so that the necessary thermal shielding Dewar is accommodated around the conductor with minimal interference from the radial support members.

The single layer magnet coil disclosed in U.S. Pat. No. 3,980,981 has several advantages, including ease of maintenance since both sides of the conductor are readily accessible, a simple construction for the conductor, reduced stresses resulting from the rippling in the conductor, accessibility of both sides of the conductor with a mechanical shorting switch to protect against failure of the cooling system, ability to surround the conductor with superfluid helium for maximum cooling efficiency, and low voltage difference levels between turns in the magnet coil. Despite the advantages of the single layer design, all of the current circulating in the superconducting coil must be carried by a single conductor. For magnet designs under consideration for power system load leveling, a current capacity of 750,000 amperes or more would be carried by the single conductor. Additionally, the resultant of the forces on the rippled conductor will be substantially radial, so that a very strong and stable outer support mass is required to carry the loads that will be imposed when the superconductor is carrying current. If the conductor is buried in and surrounded by bedrock, which is intended to carry these radial forces, the bedrock must have reasonably good structural integrity and be stable over time.

SUMMARY OF THE INVENTION

In the present invention, a superconducting energy storage magnet is constructed having two separate coils of one layer each of composite superconductor, disposed adjacent and generally parallel to one another such that the forces experienced by the conductors at each point on the conductor are directed primarily inwardly toward the other conductor. An inner support structure between the two coil layers engages the layers and provides axial support to the composite conductors. The inner support structure also is formed to absorb and carry the inwardly directed forces from the conductors in contact therewith when current is flowing through the coils. The inner support structure is so arranged that the support members in contact with each turn of coil are electrically insulated from the support members for adjacent turns on the same coil and the support members for turns of the other coil. Preferably, the spacing between turns of conductor on the inner and outer coils at the same level decreases progressively or tapers toward the top and bottom ends of the magnet. This tapering of the axial structure at both ends of the coil results in a lower tangential to normal force ratio than an untapered purely cylindrical design.

The inner support structure for the two coils preferably includes rails of good heat conducting metal, e.g., aluminum, in intimate contact with the inner facing sides of a turn of conductor. These rails are maintained at the supercooled temperature of the superconductors and, because of the intimate contact between the rails and the composite conductor, are capable of conducting away any localized heating in the composite conductor during an emergency. Each of the rails which contacts one of the turns of the inner or outer coil is separated from and also electrically isolated from the rail which contacts the next lower and next higher turn in the same coil and is similarly spaced from and electrically insulated from all of the rails which support the turns of the other coil. The electrical isolation of each rail in contact with a turn prevents short circuiting between the two coils, or between the various turns on the same coil, that may occur as a result of the substantial voltage drops that may exist across the coil as a result of changes in the magnetic field during charging and discharging of the magnet.

The entire magnet structure may be formed to reside in a relatively shallow trench in the ground rather than requiring burial in deep, structural bedrock as generally would be required for a single layer type conductor. Both inner and outer coil turns and the inner support structure are preferably rippled along the circumference of the magnet to best accommodate the residual radial stresses imposed on the composite structure. These radial stresses may be opposed and constrained by radially extending support members which connect to the supporting rails between adjacent conductors and extend out to anchorage positions on the surrounding earthen wall.

The composite conductor itself is desirably formed as a circular conductor having an inner circular tube of heat conducting aluminum and radial fins between which the composite superconductor-normal conducting material may be disposed. An outer surrounding tube of aluminum may then contain the entire conductor structure. This finned conducting structure provides local structural support for the composite conductor.

Because the inner support structure does not have to restrain the composite conductors in the two coils from expanding outwardly away from each other, the composite conductors can be left uncovered on their outer sides and extending outwardly from their points of contact with the inner support structure. This arrangement allows the inner and outer coils to be engaged in an emergency by a mechanical shorting bar which spans and shorts out all of the conductors in each coil from the top to the bottom of the coil. Such shorting can avert destructive failure conditions in the coil where localized loss of cooling in the turns results in hot spots in the composite conductor and localized loss of superconductivity.

Further objects, features, and advantages of the invention will be apparent from the following detailed description when taken in conjunction with the accompanying drawings.

DESCRIPTION OF THE PREFERRED EMBODIMENT

Figure 1:
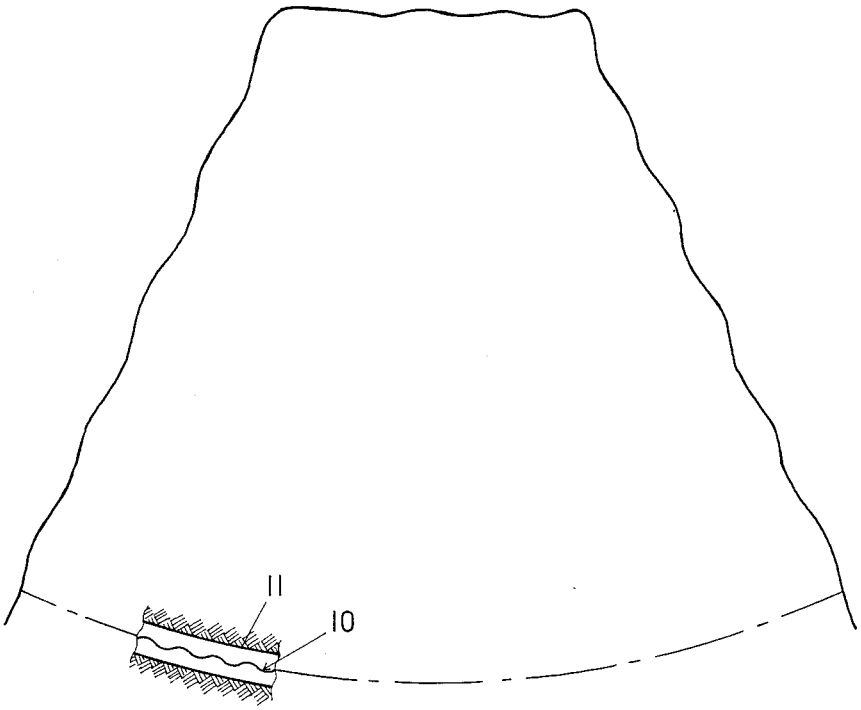
FIG. 1 is a schematic view illustrating the preferred layout of a storage magnet in accordance with the invention shown disposed in a trench.

With reference to the drawings, a portion of the superconducting magnet of the present invention is illustratively shown at 10 in FIG. 1 in the relative position that it would occupy for a large scale energy storage system constructed in a cylindrical trench 11 excavated from solid earth or bedrock. The radius of the magnet 10 would typically be in the range of several hundred meters, with the trench 11 being in the range of 5 meters wide and 20 to 30 meters deep. For illustration, the magnet structure 10 is shown with a rippled configuration, the preferred arrangement.

Figure 2:
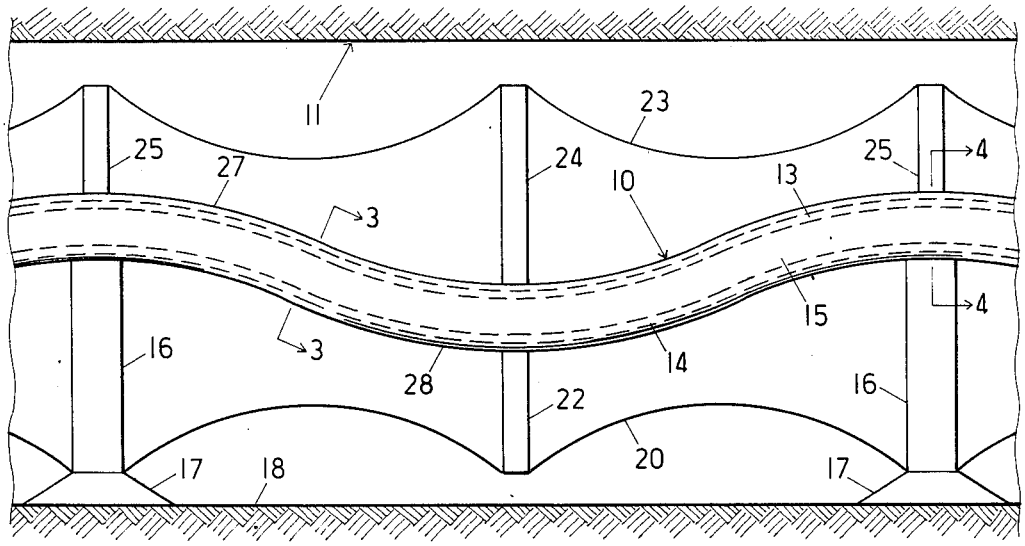
FIG. 2 is a more detailed plan view of a section of the superconducting coil between the inner and outer trench walls.

A top plan view of a portion of the magnet structure 10 within the trench 11 is shown in more detail in FIG. 2. The magnet has an inner coil 13 of composite conductor and an outer coil 14 of composite conductor. The two coils are separated and supported by an inner support structure 15, with the inner conductor 13, the outer conductor 14, and the inner support structure 15 all having the general rippled shape illustrated in FIG. 2. Outer support struts 16 extend from engagement to the support structure 15 at the innermost lobes of the ripples and extend radially outward to anchorage at 17 to the outer wall 18. An outer vacuum Dewar 20 extends the height of the magnet 10 with a concave rippled shape as shown, being attached at one end to the anchorage bases 17 and also being supported against the inwardly directed forces of the vacuum load on the Dewar by support struts 22 which extend outwardly from the inner support structure 15 to the Dewar wall 20. Similarly, an inner Dewar wall 23 is supported against the vacuum load by Dewar support struts 24 and 25 which extend from the inner support structure 15 to the Dewar wall 23 from the outer and inner lobes, respectively, of the rippled support structure. Since the net pressure on the magnet structure 10 will be directed radially outward, attachment of struts to the inner wall of the trench 11 is not required. A liquid helium containment vessel has an inner wall 27 and an outer wall 28 closely spaced from the inner coil 13 and outer coil 14, respectively, to contain the liquid helium bath which envelops the composite conductors in the two coils.

Figure 3:
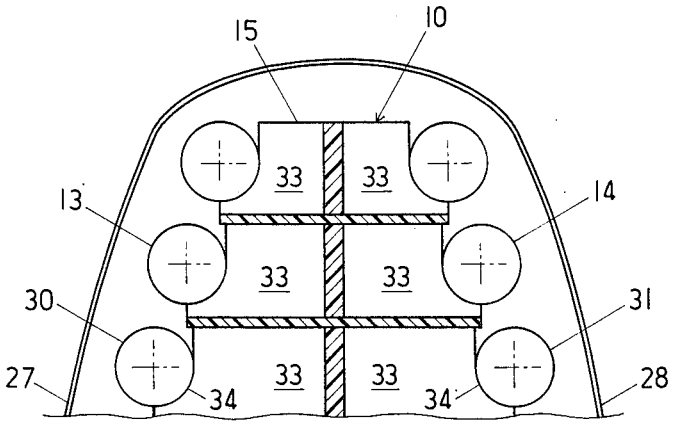
FIG. 3 is a partial schematic cross-sectional view through the magnet structure.
Figure 3:
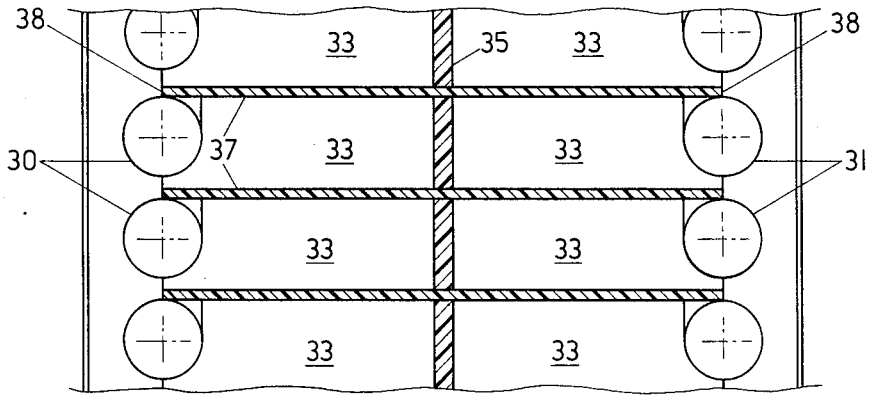

A partial cross-sectional view through the upper half of the magnet structure 10 is shown in FIG. 3, it being understood that the bottom half is essentially the mirror image thereof. The composite conductors 30 of the inner coil 13 and the conductors 31 of the outer coil 14 are provided support against axial and inwardly directed magnetic forces by the inner support structure 15. The inner support 15 is preferably a composite structure having a series of rails 33 formed of a metal which is a good conductor of both electricity and heat, such as aluminum, with each rail associated with one of the turns of either the outer conductor 31 or the inner conductor 30. Each of the rails 33 has a partial circular lip 34 formed therein which conforms to approximately a quarter of the outer circular periphery of the circular conductors 30 and 31. The lip 34 gives axial support to the turns of conductors 30 and 31 and provides a relatively large contact area over which the magnetically induced force applied by the conductors 30 and 31 can be distributed. The large area of contact between the rails and the conductors 30 and 31 also results in good electrical and thermal conduction between the conductors and the rails. Each of the rails 33 extends circumferentially in parallel with the conductors 30 and 31 and each is spaced from and electrically isolated from adjacent rails by central insulators 35, which separate and insulate rails supporting turns in the two different coils at the same level, and level insulators 37 which separate the rails which support conductors in the same coil. The insulators 35 and 37 may be formed of any suitable good electrically insulating material which also has strong structural strength, such as fiberglass-epoxy composites. As illustrated in FIG. 3, it is preferred that the level insulators 37 extend outwardly to ends 38 which contact or are close to the composite conductor beneath to prevent a rail supporting one turn in the coil from shorting to another turn of the same coil. The support rails 33 for each coil may be continuous; that is, a single support rail may be wound with the composite conductor in contact therewith for all of the turns of the coil.

Figure 4:
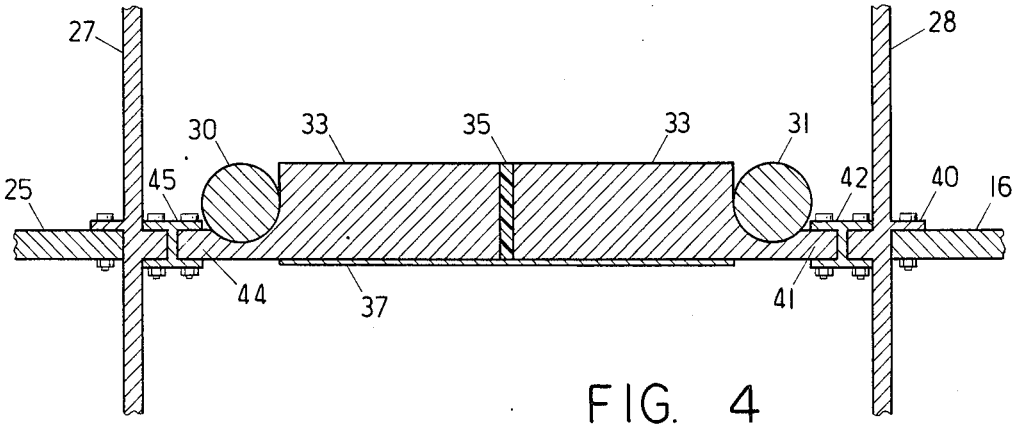
FIG. 4 is a detailed cross-sectional view of one horizontal level of the superconducting magnet structure illustrating the engagement of the composite conductors to the support rails and the engagement of the support rails to radially extending support struts.
Figure 5:
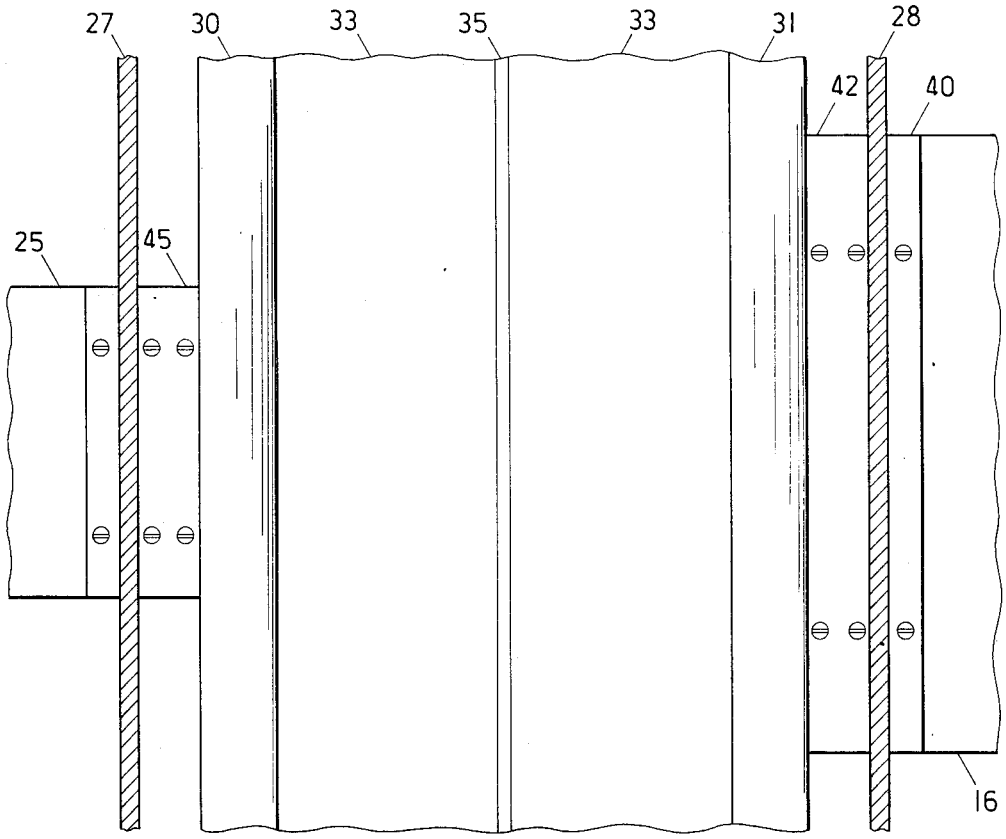
FIG. 5 is a top view of the magnet support structure of FIG. 4.

More detailed views showing the connection of the outer support struts 16 and the Dewar support struts 25 to the magnet structure are given in FIGS. 4 and 5. As illustrated in the cross-sectional view of FIG. 4, in which a single turn of both the inner and outer coils is shown, the radial support struts 16, preferably formed as panels of a structurally strong insulating material such as fiberglass-epoxy composite, is connected by fasteners at a joint 40 to the outer side of the helium containment wall 28. The rail 33 at the position of the strut 16 has an outwardly extending ledge 41 which is joined by a connector 42 to the inner side of the containment wall 28 at a position opposite that at which the outer strut 16 butts against the wall 28. Thus, the forces directed outwardly on the rail 33 will be transmitted across the helium containment wall 28 to the outward strut 16. Similarly, the Dewar support struts 25 are connected to the outer side of the inner helium containment wall 27 and an inwardly extending ledge 44 is formed on the inner of the rails 33 and is connected by a connector 45 to the inner side of the helium containment wall 27. The Dewar support struts 22 and 24 shown in FIG. 2 are connected in a similar manner.

Since the major portion of the forces exerted by the composite conductors 30 and 31 will be inwardly toward each other, i.e., toward the turn in the opposite coil at substantially the same level, very little support of the conductors 30 and 31 against outward forces is required. However, straps (not shown) may be affixed to the rails 33 and extend around the outside of the conductors 30 and 31 to hold the conductors in place against the force of gravity and restrain any minor forces that may be applied by the conductors away from the central axis of the support structure 15.

Figure 6:
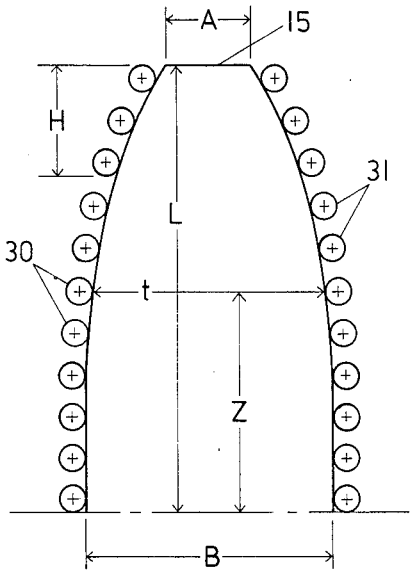
FIG. 6 is an illustrative view showing the relative tapering of the spacing between the turns of coil on the inner and outer coils at the top and bottom of the magnet structure.
Figure 7:
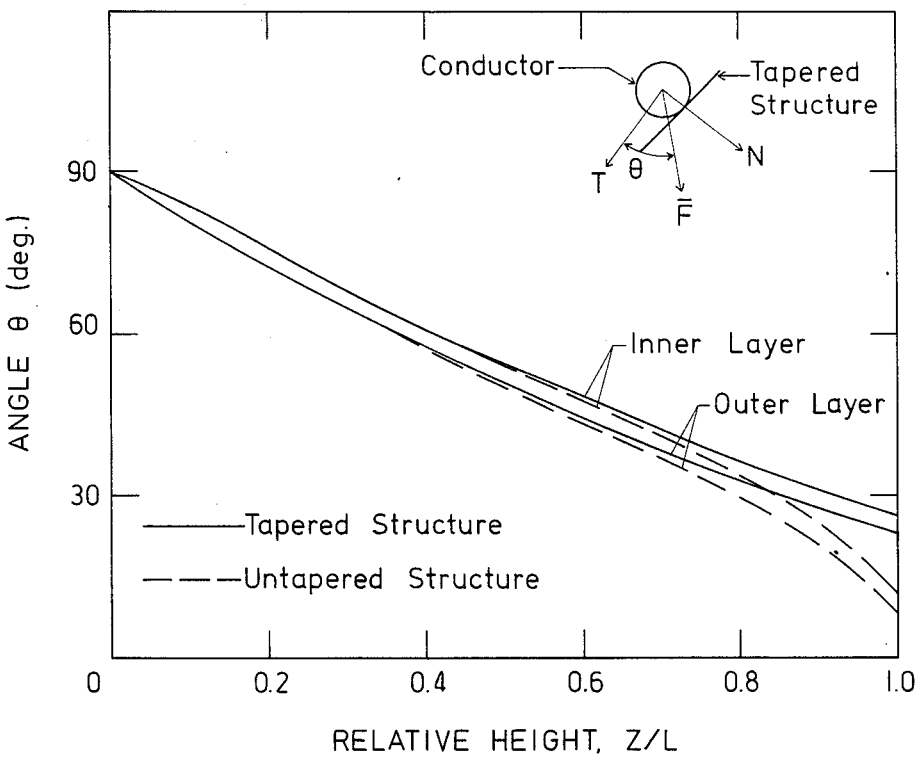
FIG. 7 is a graph illustrating the angle of support versus relative height of the support structure and comparing the tapered structure with an untapered support structure.

As noted above, the axial forces on the composite conductors 30 and 31 are transferred to the lip areas 34 of the support rail 33 which is in contact with the conductor, and the resultant of the axial and radial forces on the conductor should be directed generally to the center of the contact area between the conductor and the rail. Because the magnetic field experienced by the conductors 30 and 31 toward the top and bottom of the magnet 10 is curved away from the uniform axial magnetic field experienced by the conductors at the center of the magnet, the conductors toward the ends of the magnet will experience a progressively greater axial force. To best accommodate the greater axial than radial loading of the end conductors, it has been discovered that a tapered configuration for the spacing of the conductors 30 and 31 as shown in FIG. 3 is particularly advantageous. This tapering of the axial structure at both the top and bottom ends of the magnet results in a lower tangential to normal force ratio than would be encountered in an untapered design. The preferred relationships between the spacing t of the conductors as a function of distance from the ends of the magnet is illustrated with respect to the schematic diagram of FIG. 6 and the relative magnitudes of the tangential force T and the normal force N experienced by the inner and outer conductors as a function of the relative position of the conductors in the magnet is shown in the graph of FIG. 7. The angle $\theta$ between applied force F and the surface of the support structure shown in FIG. 7 should be large enough to properly direct the resultant forces into the supporting structure, and an angle $\theta$ of 18° or greater is required for proper support of the end conductors. As illustrated in FIG. 7, a standard straight or cylindrical coil design would result in angles substantially less than 18° at the ends of the magnet. For example, a straight vertical structure would result in a force angle $\theta$ of about 7° for the end turns, whereas a design preferably tapered in accordance with the present invention would result in a support angle of about 30° for the end turns. The preferred thickness t of the inner support structure, i.e., the spacing between the conductors and the inner and outer layer at the same level, is preferably chosen in accordance with the following expression:

$$t = 2\left[B - (B - A)e^{-\left(\frac{L-Z}{H}\right)}\right]$$

where L is much greater than H.

B and A are the thicknesses of the structure at the mid-plane and at the top (or bottom) of the coil, L is the height of the magnet from the mid-plane to either end of the magnet, H is the vertical distance from the ends of the coils at which a line tangent to the surface of the inner support structure at the ends of the coil intersects a vertical line tangent to the straight sides of the inner support structure at mid-plane, and Z is the distance from the mid-plane to the level of selected turns of inner and outer conductors.

Figure 8:
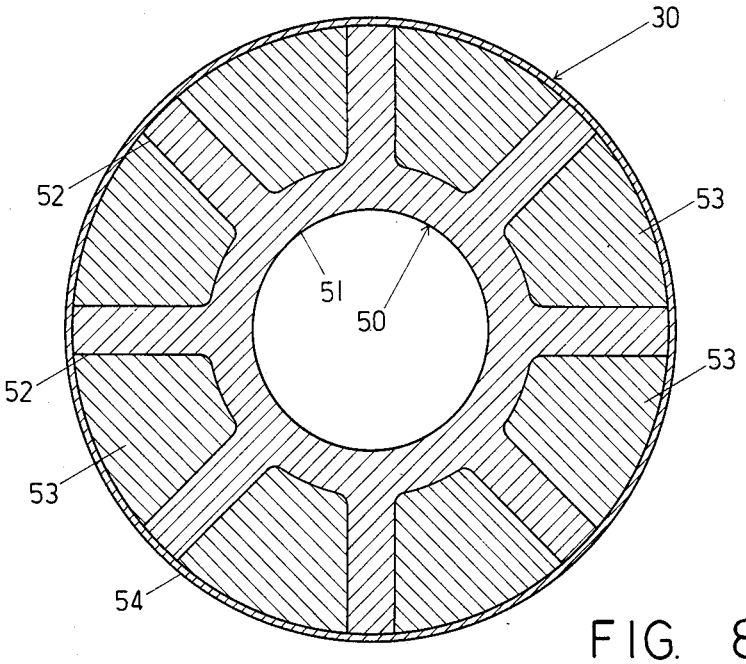
FIG. 8 is a cross-section through a preferred composite conductor.

A preferred configuration for the composite conductors 30 and 31 is illustrated in FIG. 8 (conductor 30 shown). The construction of the conductor 30 would be utilized to carry approximately 230,000 amperes at an outside diameter of 6.6 cm. The conductor has a support matrix 50 composed of a central hollow tube 51 of high strength aluminum with integrally formed fins 52 extending radially outward from the center tube 51. The hollow interior of the tube 51 may have helium coolant passed through it or may be filled with a material having high heat absorption to provide thermal stability. The wedge-shaped spaces between the fins 52 are filled with a conventional composite conductor 53 which may include superconducting niobium-titanium and high purity aluminum. The entire conductor is surrounded by a tubular outer sheath 54 of high strength aluminum. This structure, in which the superconductor is contained in a matrix of high strength aluminum, provides good load carrying support for the superconducting composite conductors 53 and transmission of the magnetic forces on them through the matrix 50 to the structural material 33.

Figure 9:
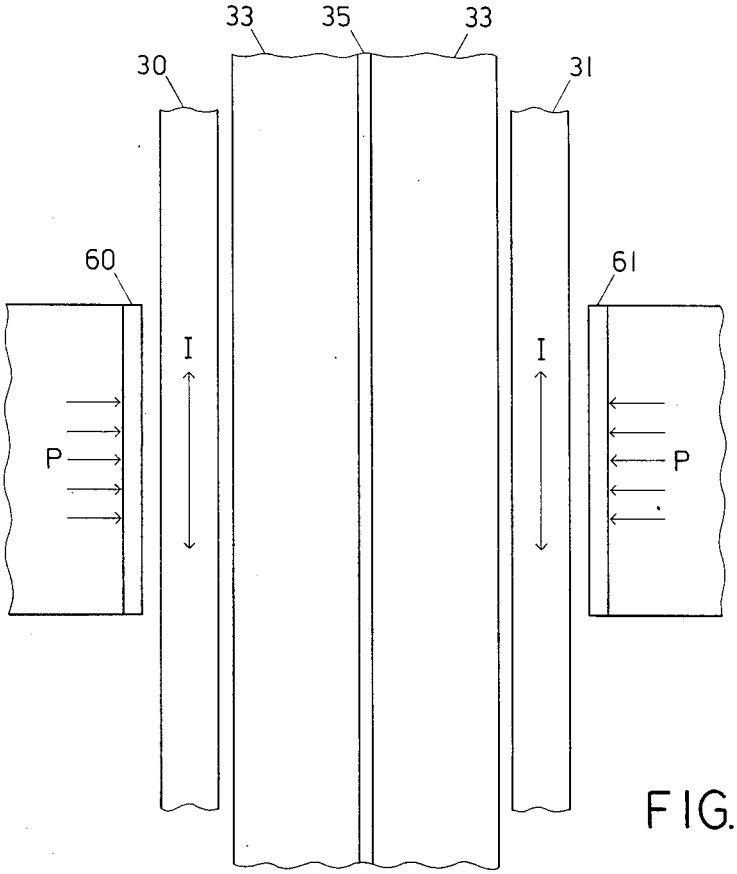
FIG. 9 is an illustrative view of a shorting switch which may be utilized with the superconducting magnet of the invention.

A large energy storage coil should have provision for neutralizing or dissipating the energy stored in case of an emergency. A significant threatening event could occur if there is excessive consumption or loss of helium coolant. This might result from a vacuum system leak or an increased thermal load due to transient losses in superconductivity which are in excess of the capacity of the cooling system. Preferably, the liquid helium reservoir should provide sufficient helium to maintain superconductivity for at least an hour after onset of a vacuum system leak or increased thermal load. To provide dissipation and protection against shorting caused by increased localized thermal loads, a mechanical switch may be provided to short all of the conductors in each of the two coils together to minimize any voltage differences across the turns of the coil. The use of such a switch is illustrated in FIG. 9, in which the shorting switch is composed of high purity aluminum bars 60 and 61 which are ordinarily spaced away from the outer periphery of the conductors 30 and 31 and are shaped along their vertical height to conform to the outer periphery of the tapered arrangement of the conductors 30 and 31. Upon detection of an emergency, the bars 60 and 61 are mechanically pressed against the conductors 30 and 31, shorting all of the turns of the conductors in each coil 14 and 15 together. A particular advantage of the two layer structure is that the conductors in the two layers are readily accessible from at least one side and which allows mechanical pressure to be applied by opposed shorting bars 60 and 61 so that no net force is applied to the magnet structure. The inward pressure from the shorting bars 60 and 61 is naturally and properly absorbed by the inner support structure, including the rails 33, and the insulating spacer 35 prevents electrical conduction between support rails 33 which are associated with conductors in opposite coils.

The protection scheme which may be utilized in an emergency involves the first step of activating the conducting switch to drive the bars 60 and 61 into contact with the conductors 30 and 31 to short all of the conductor turns in each coil; simultaneously, the same switch may be utilized to short the cold aluminum support structure comprised of the support rails 33 by contacting the rails in the spaces between adjacent turns of the coils. The liquid helium dump valve is then activated and pressurized room temperature helium gas is introduced into the helium cryostat to force the liquid helium from the cryostat into a helium reservoir in a few seconds. The high pressure incoming gas also heats the composite conductors 30 and 31 above the critical superconducting temperature, thereby coupling much of the current carried by the turns that are heated above the superconducting critical temperature to other turns still covered by the helium and to the internal aluminum rails 33. The coils and the support structure then warm up uniformly as the energy in the magnetic field is converted to heat over a period of time in a controlled manner.

The foregoing described two layer magnet coil design has several significant advantages over a single layer superconducting coil. This may be shown by analyzing the cryogenic stability condition for composite conductors, which requires that the heat generated by the conductors be equal or less than the heat removable by the liquid helium wetting the conductor surface. This further requires that the current passing through the composite conductor be determined in accordance with the expression:

$$I^2R \leqq PQ$$

This condition then imposes the constraint that:

$$I \leqq \frac{4r}{\pi^2 F_a PQ}\left[\frac{F_s B_m}{\mu_o KN}\right]^3$$

Where: P is the "wetted" perimeter area of the composite conductor; Q is the heat removed by helium per unit area; r is the final resistivity at 4° K. taking into consideration magneto-resistance and cycling strain effects; $F_a$ is the percentage of high purity aluminum cross-sectional area in the round composite conductor 30 and 31; $F_s$ is the vertical center-to-center conductor spacing divided by the conductor diameter; $B_m$ is the mid-plane field of a continuous current sheet, thin solenoid; K is the shape factor which varies between 0.5 and 1 depending on the aspect ratio; $\mu_o$ is the vacuum permeability, and N is the number of layers.

It can be seen from the expressions above that the conductor current for a two layer magnet structure is much less than for a single layer magnet since the current in the conductor decreases in proportion to the inverse third power of the number of layers. Thus, the two layer magnet structure in accordance with the present invention is allowed by cryogenic stability requirements to have a much lower current than would be required for a single layer magnet storing comparable energy in its magnetic field. The two layer coil structure of the present invention also provides lower end field magnitudes, thereby imposing lower stresses on the composite conductors near the top and bottom ends of the magnet than are encountered in a single layer design.

The separate coils 13 and 14 may be connected in series with one another (each carrying current in the same direction as illustrated in FIG. 3) and interfaced as a single coil to a power system, as described in the Peterson U.S. Pat. No. 4,122,512. Alternatively, the two coils may be entirely independent and may be independently interfaced by their own inverters to a power system grid. The firing angles of the thyristors in the invertors for the two separate coils can be appropriately controlled to maintain a balance between the two coils 13 and 14 as energy is supplied to or removed from the coils.

It is understood that the invention is not confined to the particular construction illustrated herein as exemplary, but embraces such modified forms thereof as come within the scope of the following claims.

What is claimed is:

1. A superconducting magnet comprising:

(a) a first, outer coil of one layer of conductor including at least a superconducting composite material;

(b) a second, inner coil of one layer of conductor including at least a superconducting composite material, the second coil disposed adjacent to the first coil with each turn of the second inner coil at substantially the same level as a turn on the first coil;

(c) an inner support structure between the first and second coils and engaged to the conductors thereof, including support rails associated with each turn of conductor in each coil and in contact therewith along its length at positions on the inwardly facing periphery of the conductor, the rail associated with each conductor being electrically isolated from other rails in the inner support structure, whereby the magnetic field produced by a current flowing in the same direction through the conductors of the first and second coils will produce a force on the conductors that will be directed inwardly toward the inner support structure.

2. The superconducting magnet of claim 1 wherein the spacing between the turns of conductor in the first and second coils at the same level decreases toward the top and bottom ends of the coils.

3. The superconducting magnet of claim 2 wherein the decrease in the spacing t between the conductors is in accordance with the equation:

$$t = 2\left[B - (B - A)e^{-\left(\frac{L-Z}{H}\right)}\right]$$

where B is the separation between the conductors at the middle of the coils, A is the spacing between the conductors at the top and bottom ends of the coils, L is the distance from the mid-plane of the coil to the ends of the coil, H is the vertical distance from the ends of the coil at which a line tangent to the surface of the inner support structure at the ends of the coil intersects a vertical line tangent to the inner support structure at mid-plane, and Z is the distance from the mid-plane to the level of the particular conductors in the first and second coil.

4. The superconducting magnet of claim 1 wherein the inner support structure has support rails formed of aluminum which have a partly circular outer periphery adapted to match and closely engage the outer circular periphery of a cylindrical composite conductor and terminating in a support lip which extends partially under the composite conductor to provide axial support thereto, wherein the support rails are stacked one above the other for each coil from the bottom to the top of the coil and including insulating material between each layer of support rails in the first and second coils and insulating material extending vertically between the adjacent support rails of the first and second coils such that each support rail is electrically isolated from adjacent support rails at any position in the magnet.

5. The superconducting magnet of claim 1 wherein the turns of the inner and outer coils and the support rails in the inner support structure in contact therewith have outwardly bowed ripples therein and inner portions between the ripples with the ripple pattern extending around the circumferential periphery of the magnet structure.

6. The superconducting magnet of claim 5 including support struts extending from attachment to the inner support structure and extending radially outward to engagement with a surrounding supporting mass.

7. The superconducting magnet of claim 1 wherein the composite conductor includes an internal matrix of conducting metal having an inner tubular member and radially extending fins formed integrally therewith, with composite superconductor and normal conductor formed in the spaces between the radially extending fins.

8. The superconducting magnet of claim 5 wherein the magnet structure is formed in a trench in solid earth wherein the outer support wall is the outer wall of the trench and wherein the support struts extend to attachment to the outer support wall of the trench.

9. The superconducting magnet of claim 6 wherein portions of the support rails have a ledge extension which extends out beyond the outer periphery of the composite conductor and wherein the support struts are connected to the extended ledges of the rails at the positions of the extensions.

10. The superconducting magnet of claim 5 including an inner and outer helium containment wall surrounding the magnet structure and wherein the struts are connected to the outer containment wall and the support rails are connected to the outer containment wall at the position of the struts to transmit force from the support rails through the containment wall to the struts.

11. The superconducting magnet of claim 10 including Dewar support struts extending from attachment to ledge extensions of the rails at positions on the support rails which extend radially outward and are connected at their outer ends to support a Dewar wall which surrounds the inner and outer coils, whereby the Dewar wall is entirely supported by the internal support structure of the magnet and external supports for the Dewar wall are not required.

12. The superconducting magnet of claim 1 including a mechanical shorting switch comprising conductive bars spaced away from the inner and outer coil conductors and conforming in shape to the vertical placement of the conductors and positioned to be forced into contact with the conductors of each coil to short the same together under emergency conditions.

13. A superconducting magnet comprising:

(a) a first, outer coil of one layer of conductor including at least a superconducting composite material;

(b) a second, inner coil of one layer of conductor including at least a superconducting composite material, the second coil disposed adjacent to the first coil with each turn of the second inner coil at substantially the same level as a turn on the first coil;

(c) an inner support structure between the first and second coils and engaged to the conductors thereof, the inner support structure being tapered such that the spacing between the turns of conductor in the first and second coils at the same level decreases toward the top and bottom ends of the coils, whereby the magnetic field produced by a current flowing in the same direction through the conductors of the first and second coils will produce a force on the conductors that will be directed inwardly toward the inner support structure.

14. The superconducting magnet of claim 13 wherein the decrease in the spacing t between the conductors is in accordance with the equation:

$$t = 2\left[B - (B - A)e^{-\left(\frac{L-Z}{H}\right)}\right]$$

where B is the separation between the conductors at the middle of the coils, A is the spacing between the conductors at the top and bottom ends of the coils, L is the distance from the mid-plane of the coil to the ends of the coil, H is the vertical distance from the ends of the coil at which a line tangent to the surface of the inner support structure at the ends of the coil intersects a vertical line tangent to the inner support structure at mid-plane, and Z is the distance from the mid-plane to the level of the particular conductors in the first and second coil.

15. The superconducting magnet of claim 13 wherein the inner support structure has support rails formed of aluminum associated with each turn of conductor in each coil and in contact therewith along its length at positions on the inwardly facing periphery of the conductor which have a partly circular outer periphery adapted to match and closely engage the outer circular periphery of a cylindrical composite conductor and terminating in a support lip which extends partially under the composite conductor to provide axial support thereto, wherein the support rails are stacked one above the other for each coil from the bottom to the top of the coil and including insulating material between each layer of support rails in the first and second coils and insulating material extending vertically between the adjacent support rails of the first and second coils such that each support rail is electrically isolated from adjacent support rails at any position in the magnet.

16. The superconducting magnet of claim 13 wherein the inner support structure includes support rails associated with each turn of conductor in each coil and in contact therewith along its length at positions on the inwardly facing periphery of the conductor, the rail associated with each conductor being electrically isolated from other rails in the inner support structure, and wherein the turns of the inner and outer coils and the support rails in the inner support structure in contact therewith have outwardly bowed ripples therein and inner portions between the ripples with the ripple pattern extending around the circumferential periphery of the magnet structure.

17. The superconducting magnet of claim 16 including support struts extending from attachment to the inner support structure and extending radially outward to engagement with a surrounding supporting mass.

18. The superconducting magnet of claim 13 wherein the composite conductor includes an internal matrix of conducting metal having an inner tubular member and radially extending fins formed integrally therewith, with composite superconductor and normal conductor formed in the spaces between the radially extending fins.

19. The superconducting magnet of claim 16 wherein the magnet structure is formed in a trench in solid earth wherein the outer support wall is the outer wall of the trench and wherein the support struts extend to attachment to the outer support wall of the trench.

20. The superconducting magnet of claim 17 wherein portions of the support rails have a ledge extension which extends out beyond the outer periphery of the composite conductor and wherein the support struts are connected to the extended ledges of the rails at the positions of the extensions.

21. The superconducting magnet of claim 16 including an inner and outer helium containment wall surrounding the magnet structure and wherein the struts are connected to the outer containment wall and the support rails are connected to the outer containment wall at the position of the struts to transmit force from the support rails through the containment wall to the struts.

22. The superconducting magnet of claim 13 including Dewar support struts extending from attachment to ledge extensions of the rails at positions on the support rails which extend radially outward and are connected at their outer ends to support a Dewar wall which surrounds the inner and outer coils, whereby the Dewar wall is entirely supported by the internal support structure of the magnet and external supports for the Dewar wall are not required.

23. The superconducting magnet of claim 13 including a mechanical shorting switch comprising conductive bars spaced away from the inner and outer coil conductors and conforming in shape to the vertical placement of the conductors and positioned to be forced into contact with the conductors of each coil to short the same together under emergency conditions.

* * * * *